US006874170B1

(12) United States Patent
Aaron

(10) Patent No.: US 6,874,170 B1
(45) Date of Patent: Apr. 5, 2005

(54) HEAD AND NECK PROTECTION SYSTEM

(76) Inventor: Todd D. Aaron, 10 Cottonwood Ct., Lafayette Hill, PA (US) 19444

( * ) Notice: Subject to any disclaimer, the term of this patent is extended or adjusted under 35 U.S.C. 154(b) by 0 days.

(21) Appl. No.: 10/704,780

(22) Filed: Nov. 10, 2003

(51) Int. Cl.[7] ..... A41D 13/00
(52) U.S. Cl. ..... 2/468; 2/421; 2/425
(58) Field of Search ..... 2/425, 410, 424, 2/422, 468, 411, 421, 462, 415

(56) References Cited

U.S. PATENT DOCUMENTS

| | | | | | |
|---|---|---|---|---|---|
| 2,597,764 | A | * | 5/1952 | Tucker et al. | 2/424 |
| 3,134,106 | A | * | 5/1964 | Shaffer et al. | 2/462 |
| 3,551,910 | A | | 1/1971 | Raschke | |
| 3,577,562 | A | | 5/1971 | Holt | |
| 3,590,388 | A | | 7/1971 | Holt | |
| 3,600,713 | A | | 8/1971 | Holt | |
| 3,628,190 | A | | 12/1971 | Molitoris | |
| 3,668,706 | A | | 6/1972 | Velasquez | |
| 3,671,974 | A | * | 6/1972 | Sims | 2/421 |
| 3,688,314 | A | * | 9/1972 | Hill | 2/457 |
| 3,818,509 | A | * | 6/1974 | Romo et al. | 2/421 |
| 3,873,996 | A | | 4/1975 | Varteressian | |
| 3,879,761 | A | | 4/1975 | Bothwell | |
| 3,900,896 | A | | 8/1975 | Ackerman | |
| 3,925,822 | A | * | 12/1975 | Sawyer | 2/421 |
| 3,978,525 | A | | 9/1976 | Bothwell | |
| 4,042,976 | A | * | 8/1977 | Reynolds | 2/135 |
| 4,094,015 | A | | 6/1978 | Howard | |
| 4,215,437 | A | * | 8/1980 | Kao | 2/424 |
| 4,219,193 | A | | 8/1980 | Newman | |
| 4,274,161 | A | | 6/1981 | Littler | |
| 4,319,362 | A | | 3/1982 | Ettinger | |
| 4,477,041 | A | | 10/1984 | Dunne | |
| 4,638,510 | A | | 1/1987 | Hubbard | |
| 4,697,289 | A | | 10/1987 | Luigi | |
| 4,821,339 | A | | 4/1989 | Fair | |
| 4,825,476 | A | | 5/1989 | Andrews | |
| 4,885,807 | A | | 12/1989 | Snow, Jr. | |
| 4,985,938 | A | | 1/1991 | Snow, Jr. | |
| 4,996,720 | A | | 3/1991 | Fair | |
| 5,095,550 | A | * | 3/1992 | Perlinger | 2/422 |
| 5,261,125 | A | | 11/1993 | Cartwright et al. | |
| 5,272,770 | A | * | 12/1993 | Allen et al. | 2/421 |
| 5,295,271 | A | | 3/1994 | Butterfield et al. | |
| 5,329,641 | A | | 7/1994 | Kalhous | |
| 5,371,905 | A | | 12/1994 | Keim | |
| 5,437,613 | A | | 8/1995 | Reggio et al. | |
| 5,517,699 | A | | 5/1996 | Abraham | |
| 5,566,399 | A | | 10/1996 | Cartwright et al. | |
| 5,581,816 | A | | 12/1996 | Davis | |
| 5,581,820 | A | | 12/1996 | Cartwright et al. | |
| 5,787,513 | A | | 8/1998 | Sharmat et al. | |
| 5,946,719 | A | | 9/1999 | Crupi et al. | |
| 5,956,777 | A | | 9/1999 | Popovich | |
| 6,009,563 | A | * | 1/2000 | Swanson et al. | 2/425 |
| 6,009,566 | A | | 1/2000 | Hubbard | |

(Continued)

*Primary Examiner*—Rodney M. Lindsey
(74) *Attorney, Agent, or Firm*—Dann, Dorfman, Herrell and Skillman, P.C.

(57) ABSTRACT

A head and neck protection system includes a head protector, a shoulder protector, and a neck guard for protecting an athlete from injury. The neck guard detachably connects between the head protector and the shoulder protector and includes a collar. The collar has a first edge and a second edge spaced apart from the first edge and longer than the first edge. The first and second edges include fasteners for detachably coupling the collar between the head protector and the shoulder protector. The collar has a perimeter that flares radially outwardly as the collar extends from the head protector to the shoulder protector. The collar interconnects the head protector with the shoulder protector to form a restraint that limits displacement of the head protector relative to the shoulder protector.

21 Claims, 3 Drawing Sheets

U.S. PATENT DOCUMENTS

| | | | | |
|---|---|---|---|---|
| 6,032,299 | A | | 3/2000 | Welsh |
| 6,163,891 | A | | 12/2000 | Viitalahti |
| 6,182,300 | B1 | | 2/2001 | Severance |
| 6,253,389 | B1 | | 7/2001 | Scaglione |
| 6,374,423 | B1 | | 4/2002 | Anderson et al. |
| 6,381,750 | B1 | | 5/2002 | Mangan |
| 6,385,781 | B1 | | 5/2002 | Rose et al. |
| 6,434,756 | B1 | | 8/2002 | Hoop |
| 6,481,026 | B1 | * | 11/2002 | McIntosh ..... 2/468 |
| 2002/0069873 | A1 | | 6/2002 | Hetzel |
| 2002/0100109 | A1 | | 8/2002 | Hoop |

* cited by examiner

HEAD AND NECK PROTECTION SYSTEM

FIELD OF THE INVENTION

The present invention relates generally to safety equipment, and particularly to protective gear for the head and neck that can be used in a variety of activities involving risk of injury.

BACKGROUND

Athletes use a variety of protective helmets and pads when engaging in sports. For example, athletes engaged in football, lacrosse, hockey, auto racing and equestrian competition routinely use helmets for head protection. Safety standards for protective gear frequently conflict with other concerns, such as comfort. As a result, many head and neck guards sacrifice comfort for safety, or vice versa. A number of head and neck guards in the present state of the art have large bulky components that surround the head, neck and shoulders. Although these guards reduce the risk of injury, they add significant weight to the athlete's gear and interfere with the athlete's mobility. Some head and neck guards include elaborate cages or masks around the head that obstruct the athlete's vision. A few head and neck guards include springs or hydraulic pistons that are designed to absorb shocks. Although springs and pistons can dissipate energy during a head collision, they are prone to wear and add significant weight to the equipment. Other head and neck guards provide support only for the rear of the head and neck. The rear support protects the person's head and neck when the head is deflected rearwardly, but fails to provide protection when the head is deflected in other directions.

Head and neck guards in the present state of the art are also costly for the user. Many head and neck guards are designed for specific sports or are compatible only with specific brands of equipment. Individuals who participate in multiple sports must purchase equipment that is specifically designed for each sport. The expense of purchasing separate equipment for each sport can be excessive. In addition to cost, many head and neck guards are difficult to put on and remove. For all of the foregoing reasons it can be seen that head and neck guards in the present state of the art leave much to be desired in the areas of safety, comfort, cost and ease of use.

The protective gear presently used in football has specific drawbacks arising from the extreme level of physical contact in the sport. Football players routinely collide with opponents as part of the game, and a large number of body contacts occur on a player's helmet. Impact forces on a football helmet are directed into the player's head and down through the neck and spine. As a result, compression forces are directly imposed on the neck and spine, creating significant risk of injury. The known football helmets are usually unrestrained other than by a chin strap. Furthermore, the helmets are usually disconnected from other parts on the uniform. These design limitations permit a player's head to deflect in any direction and at a severe angle during a collision with another player. If the player experiences a high speed helmet collision, the collision can cause severe neck injury, including neck hyperextension (rearward deflection of the neck) or neck hyperflexion (forward deflection of the neck). Football players seldom wear padding over their necks, leaving their necks completely exposed. As a result, there is no protection against cuts, abrasions, or other surface injuries on the neck, which can be caused by contact with other players. Nor is there any protection against the effects of cold winds, rain, snow, or other elements.

Most football helmets are secured on the football player's head by a chin strap, which prevents the helmet from being knocked off of the player's head during a helmet collision. The chin strap can rub against the player's chin, collect perspiration, and prove very uncomfortable for the player. This discomfort can discourage players from using chin straps, subjecting the players to a greater risk of head injury. Even when worn, chin straps are not without their own risks, and tightly worn chin straps can actually exacerbate a head injury. The disadvantages of tight chin straps are best understood by appreciating the advantages of a football helmet that slides a small degree on the player's head. To protect a player from head injury, the football helmet must absorb and dissipate energy from the collision before the impact force reaches the player's head. A small amount of sliding between the helmet and the player's scalp is preferable, because the friction between the sliding helmet and the scalp dissipates some of the energy from the helmet collision. A tight chin strap prevents sliding motion of the helmet on the scalp, and energy from the helmet collision travels through the helmet and directly to the players head. Therefore, it is desirable to have a football helmet restraint that secures the football helmet to the head, while avoiding the problems associated with chin straps.

SUMMARY OF THE INVENTION

The problems associated with the known types of head gear are solved to a great degree by a head and neck protection system in accordance with the present invention. In a first aspect of the invention, a head and neck guard includes a strip of elastic material having a first edge portion and a second edge portion in spaced relation to the first edge portion. A first fastening means is disposed along the first edge portion for attaching the strip to a helmet or other form of head protection. A second fastening means is disposed along the second edge portion for attaching the strip to shoulder gear, which may be, for example a jersey, vest, jacket or shoulder pads.

In a second aspect of the invention, a head and neck protection system includes a head protector, a shoulder protector, and a neck guard for protecting an athlete from injury. The neck guard extends between the head protector and the shoulder protector and includes a collar. The collar has a first edge and a second edge spaced apart from the first edge. The first and second edges on the collar connect with the head protector and shoulder protector. The collar provides a flexible brace between the head protector and shoulder protector that absorbs shock and limits movement of the head and neck during a collision. The neck guard may be permanently connected with the head protector and shoulder protector. Preferably, the neck guard includes fasteners for detachably coupling the neck guard between the head protector and the shoulder protector. The fasteners permit the neck guard to detachably connect with a variety of equipment used in different sports and activities. The collar preferably has a perimeter that flares radially outwardly as the collar extends from the head protector to the shoulder protector. In this arrangement, the neck guard distributes forces outwardly and away from the neck and spine into the shoulders and torso.

In a third aspect of the invention, the head and neck protection system is adapted for use in the sport of football. The protection system includes a football helmet, a shoulder pad, and a neck guard detachably connected with the helmet and shoulder pad. The collar has a first edge and a second edge spaced apart from the first edge. A first fastener means extends along the first edge of the collar and connects with the football helmet. A second fastener means extends along the second edge of the collar and connects with the shoulder protector. The neck guard interconnects the helmet with the shoulder pad to form an annular restraint around the wearer's neck that absorbs shock, limits displacement of the football player's head relative to the shoulder pads, and shields the neck area. Since the helmet is secured to the neck guard and the shoulder pads, the head and neck protection system eliminates the need for a chin strap.

DESCRIPTION OF THE DRAWINGS

The foregoing summary as well as the following description will be better understood when read in conjunction with the figures in which.

DETAILED DESCRIPTION OF THE PREFERRED EMBODIMENT

Figure 1:
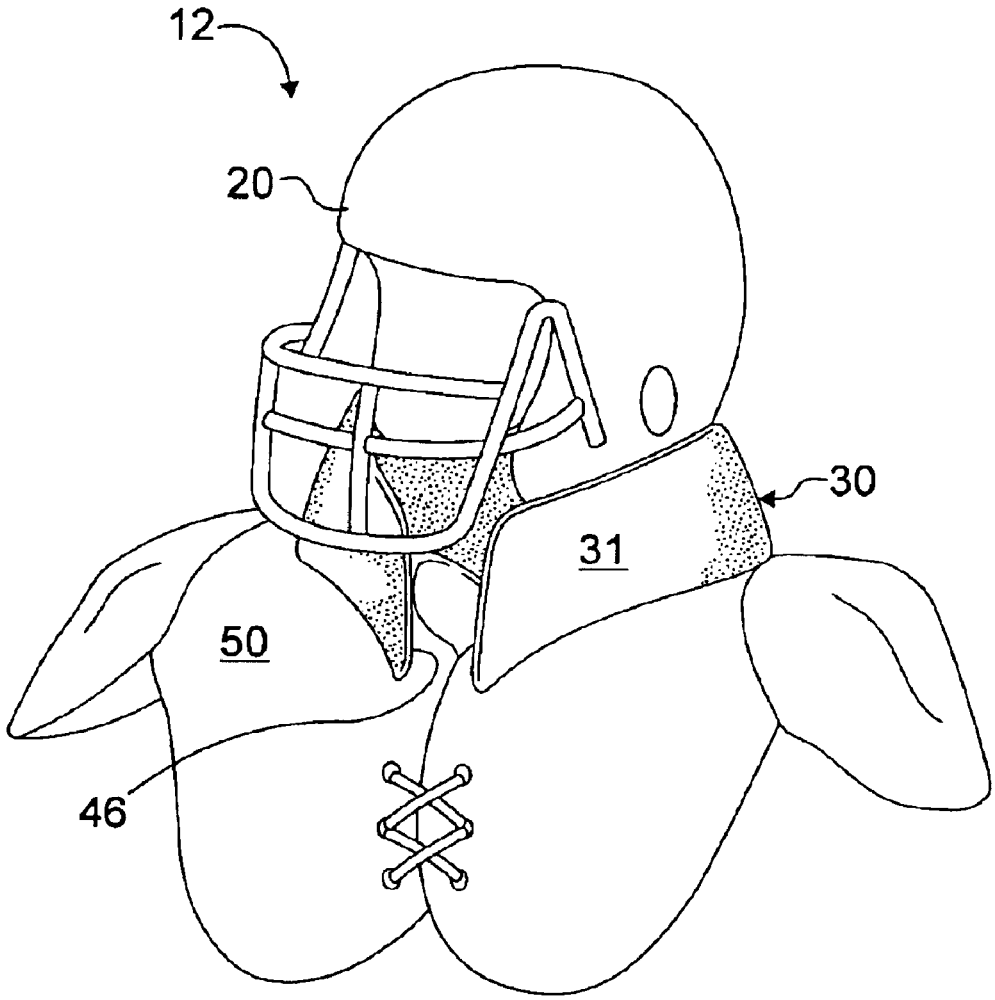
FIG. 1 is a perspective view of a head and neck protection system in accordance with the present invention.

Referring to the drawing figures, and in particular to FIG. 1, a head and neck protection system 12 is shown. The protection system 12 includes a head protector 20, a neck guard 30, and shoulder gear 50. The neck guard 30 is connected between the head protector 20 and the shoulder gear 50 to form a shock-absorbing brace between the head protector and shoulder gear that substantially prevents hyperextension of the neck, hyperflexion of the neck, and other serious head and neck injury. The neck guard 30 is sufficiently flexible and light-weight to permit normal head rotation about the axis of the wearer's neck.

The protective system 12 is intended for use in a variety of sports and activities, including but not limited to football, auto racing, motorcycling, lacrosse, and equestrian competition. Therefore, the protective system 12 may include different forms of protective gear. In the case of auto racing, for example, the neck guard 30 may be connected between a racing helmet and a fire suit. In equestrian competition, the neck guard 30 may be connected between a helmet and a jacket or vest. The term "head protector" encompasses a variety of head gear, including but not limited to hats and helmets. The term "shoulder gear" or "shoulder protector" encompasses a variety of equipment and apparel worn over the chest or shoulders, including but not limited to shoulder pads, jerseys, vests, jackets and fire suits. In the following description, the protection system 12 will be described as it would be used with a football helmet 20 and shoulder pads 50 used in the sport of football.

Figure 2:
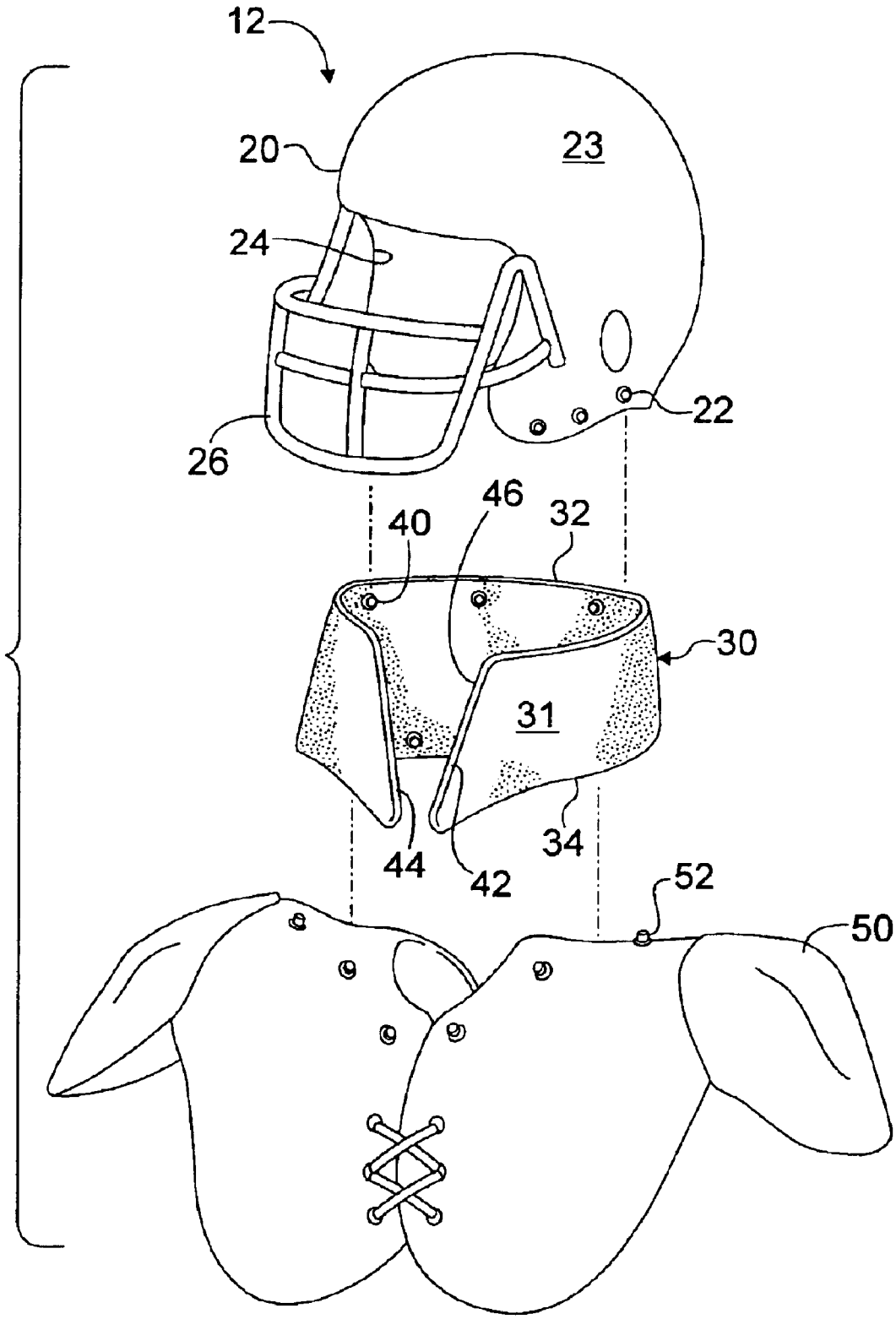
FIG. 2 is an exploded perspective view of the head and neck protection system of FIG. 1.

Referring now to FIG. 2, the neck guard 30 includes a collar 31 that is formed to extend substantially around a person's neck. The collar 31 has a first edge portion 32 constructed to connect with a base portion of the football helmet 20, and a second edge portion 34 constructed to connect with the shoulder pads 50. When the collar 31 is connected with the football helmet 20 and shoulder pads 50, the collar forms a protective restraint that absorbs shock and limits displacement of the head and neck. The neck guard 30 secures the helmet 20 to the shoulder pads 50, substantially preventing the dislodging or removal of the helmet during contact. As a result, the neck guard 30 may be used in conjunction with or in place of a chin strap.

The helmet 20 has a hollow body 23 and a face opening 24 that partially exposes the player's face when the helmet is placed over the player's head. A face mask 26 extends over the face opening 24 to protect the player's face from injury. The neck guard 30 engages with the base of helmet 20 and provides an annular buttress or brace around the base of the helmet. The first edge 32 of the collar 31 extends around the base of the helmet 20 in a generally circular arrangement. The neck guard 30 extends downwardly toward the shoulder pads 50 and surrounds the person's neck. The second edge 34 of the collar 31 connects with the shoulder pads 50 in a generally circular arrangement, similar to the circular arrangement of the first edge 32.

Figure 3:
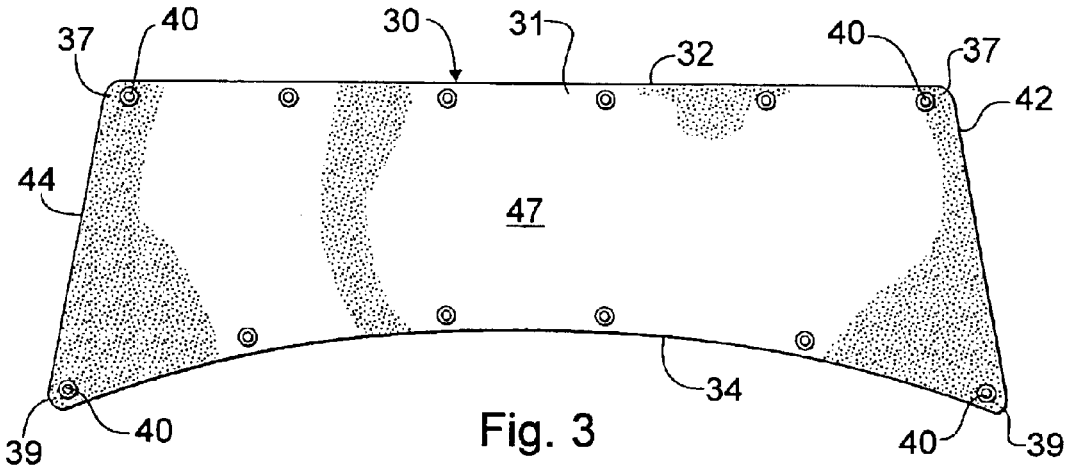
FIG. 3 is a side elevation view of a neck guard used in the head and neck protection system of FIG. 1, showing a first side of the neck guard.
Figure 4:
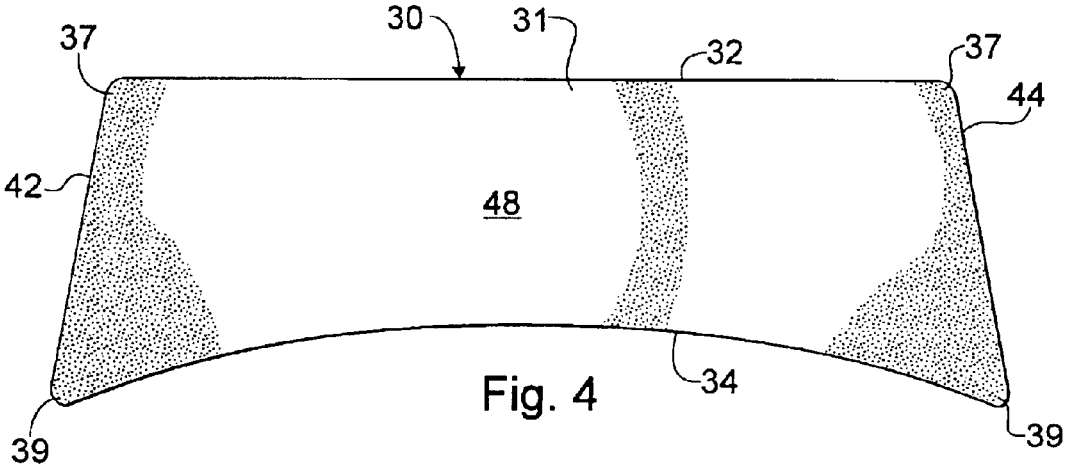
FIG. 4 is a side elevation view of the neck guard used in the head and neck protection system of FIG. 1, showing a second side of the neck guard.

The neck guard 30 extends around the player's neck in a tubular fashion, covering a substantial portion of the player's neck. In this arrangement, the neck guard shields the neck to substantially prevent the occurrence of neck abrasions, lacerations, cuts or irritations caused by contact with other players, harsh winds or other elements. Referring to FIGS. 3–4, the second edge 34 of the collar 31 is preferably longer than the first edge 32, so that the collar 31 has a generally trapezoidal shape when the collar is laid flat. In this configuration, the collar 31 forms a generally frustoconical enclosure around the player's neck when the collar is connected between the helmet 20 and shoulder pads 50. The collar 31 flares radially outwardly as it extends from the helmet 20 toward the shoulder pads 50. The flared profile of the neck guard 30 distributes forces outwardly and away from the neck and spine. The neck guard 30 may also be formed with other configurations to distribute forces away from the helmet. For example, the strip may be hourglass-shaped with the first and second edges of the collar 31 of more or less equal length so as to form a generally cylindrical tube of uniform diameter when the neck guard is placed around the neck between the helmet 20 and shoulder pads 50.

The outwardly expanding neck guard 30 in the preferred embodiment provides significant advantages over other neck guard configurations. Since the wall of the collar 31 expands outwardly as it extends from the helmet 20 to the shoulder pads 50, the collar absorbs forces applied to the helmet and disperses those forces outwardly to the shoulders and torso. With this arrangement, forces are directed outwardly and away from the spine and vertebrae, reducing the risk of head and spinal injury. The collar 31 also anchors the position of the helmet 20 relative to the shoulder pads 50 to limit lateral deflection of the head and over extension of the neck during a helmet collision. The collar 31 is configured to extend substantially around the entire neck area, limiting displacement of the neck regardless of the direction of contact.

The collar 31 may be formed using a variety of materials, and the specific material used may be selected based on a number of factors, including but not limited to the desired amounts of flexibility and ventilation of body heat from the neck area. In the preferred embodiment, the collar 31 is preferably formed of a strip of resilient elastomer, such as neoprene. The elastomeric material preferably has a thickness which is selected to provide resistance to lateral deflection while providing sufficient flexibility to permit rotation of the head about the axis of the neck. Other materials and thicknesses may be used in the neck guard 30 with satisfactory results. The elastic property of elastomers provides variable resistance to stress that increases as the material deforms. During initial stress, the elastomer provides a relatively small amount of tensile elasticity, allowing the collar to deform a small degree. This permits the player to turn his/her head through a limited range about the axis of the neck. As the collar material is stressed further, however, the tensile elasticity increases dramatically to limit further movement of the head about any of the axes of rotation relative to the shoulder pads. As a result, the elastomer provides controlled displacement of the head and neck relative to the shoulder pads. Aside from their elastic properties, many elastomers provide a relatively light-weight material that adds very little weight to the player's uniform. The tensile elasticity of elastomeric material can also provide beneficial exercise to neck muscles when worn and stretched between a helmet and shoulder pads.

The collar 31 may be formed of one or more solid panels or sections of material that connect around the base of the helmet 31 to form an annular restraint and shock absorbing brace. The number of sections that form the collar is not a critical aspect of the present invention. In FIGS. 1–5, the collar 31 is formed from a single solid strip of material. The collar 31 may also be formed of two or more separate panels or sections that connect around the base of the helmet. The separate panels collectively form a restraint and shock absorbing brace, similar to a single strip of material.

Figure 5:
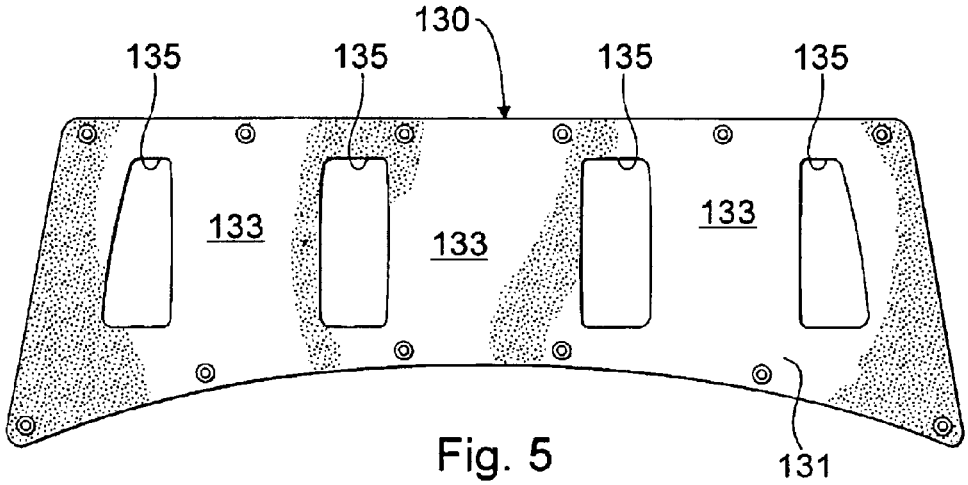
FIG. 5 is a side elevation view of an alternate embodiment of a neck guard in accordance with the present invention.

Thus far, the collar 31 has been illustrated and described as a solid strip of material, or solid sections of material, that surround a substantial portion of the player's neck when connected between the helmet 20 and shoulder pads 50. However, a solid collar is not essential, and other collar configurations may be desirable within the scope of the present invention. Referring to FIG. 5, an alternate neck guard 130 is shown. The neck guard 130 includes a partially open collar 131 with an array of web-like panels or extensions 133. The panels 133 are spaced incrementally from one another between apertures 135 formed in the collar 131. In this arrangement, the panels 133 provide restraints that stabilize the helmet and limit displacement of the helmet relative to the shoulder pads. The apertures 135 provide increased flexibility and ventilation, while reducing the weight of the neck guard 130. The neck guard 130 may be desirable for use during hotter weather, football practices, football scrimmages, or other conditions where greater flexibility and ventilation are desired.

The neck guard 30 may be connected with the helmet 20 and shoulder pads 50 in a variety of ways. For example, the neck guard 30 may be permanently connected with the helmet 20, permanently connected with the shoulder pads 50, or permanently connected with both the helmet and the shoulder pads. The neck guard 30 may be permanently attached to the helmet and shoulder pads using any suitable connection, including but not limited to high strength adhesive or metallic rivets. In the preferred embodiment, the neck guard 30 is detachably connected with the helmet 20 and shoulder pads. A variety of detachable connection means may be used, including but not limited to zippers, hook and loop fastener strips, snap fasteners, and combinations thereof.

Referring to FIGS. 2–4, the neck guard 30 comprises a plurality of snap fasteners 40 for connecting the collar 31 to the helmet 20 and shoulder pads 50. The collar 31 has an inner face 47 and an outer face 48. The inner face 47 has a plurality of snap fasteners 40 incrementally spaced along the first and second edges 32, 34 of the collar 31. The helmet 20 includes a series of snap connectors 22 incrementally spaced around the base of the helmet. The shoulder pads 50 include a series of similar snap connectors 52 that extend around the neck opening. The snap fasteners 40 on the first edge 32 of the collar 31 detachably connect with the snap connectors 22 on the helmet 20, and the snap fasteners on the second edge 34 of the collar detachably connect with the snap connectors 52 on the shoulder pads 50.

Referring to FIGS. 3–4, the collar 31 includes a third edge 42 and a fourth edge 44 that extend between the first and second edges 32, 34. The first edge 32 of the collar 31 intersects with the third and fourth edges 42, 44 of the collar to form a pair of upper corners 37, and the second edge 34 of the collar 31 intersects with the third and fourth edges 42, 44 of the collar to form a pair of lower corners 39. The upper corners 37 each preferably include a snap fastener 40 configured to connect with a snap connector 22 on the sides of face opening 24 on the helmet 20. The lower corners 39 each preferably include a snap connector 40 configured to connect with a snap connector 52 on the front section of the shoulder pads 50. When the neck guard 30 is connected between the helmet 20 and shoulder pads 50, the third and fourth edges 42, 44 of the collar are preferably separated, forming a gap or opening 46 beneath the face mask at the front of the helmet. The gap 46 permits ventilation of body heat that accumulates between the neck guard and the player's skin. The gap 46 also forms a clearance space through which the player may insert one or more fingers to remove the neck guard from the helmet and shoulder pads, while leaving the helmet and shoulder pads on. In this arrangement, the neck guard can be readily connected to and detached from the helmet 20 and shoulder pads 50. The snap fasteners 40 and snap connectors 22, 52 may be mounted to the collar 31, helmet 20 and shoulder pads 50 with a bonding agent, stitching, a combination of bonding and stitching, or other connection suitable for mounting the snap fasteners and connectors.

The operation and function of the protective system 12 will now be described in more detail. In football, a large number of head collisions occur on the side of the helmet, with impact forces concentrated on one side of the player's helmet. In response to the impact, the player's head deflects away from the source of impact. Without neck restraints or guards, the player's head is free to tilt and deflect in response to the collision. Helmet collisions that occur at high speed can result in hyperextension of the neck, hyperflexion of the neck, or other serious neck injury. The neck guard 30 is configured to substantially prevent serious head and neck injury by partially immobilizing the head and neck relative to the shoulders. The collar 31 extends between the helmet 20 and shoulder pads 50 in a relatively snug arrangement that limits the extent to which the player's helmet can be tilted relative to the shoulder pads. When the player experiences contact at the front of the helmet, for example, the impact force is directed rearwardly. The front section of the collar 31, which is initially in a relaxed state, deflects and deforms a small amount before being pulled taut. The small amount of deflection and deformation in the collar permits the player's head to tilt back slightly until the collar is pulled taut. At this point, the tensile strength of the collar 31 resists additional deformation at the front of the collar (beneath the player's chin), thereby limiting rearward displacement of the player's head. In the relaxed condition, the annular collar 31 is pulled snugly between the helmet 20 and shoulder pads 50 on all sides of the player's helmet. Therefore, the collar 31 provides tensile resistance against head and neck displacement in any direction. As the tensile resistance of the elastomeric collar increases during elastic deformation, the collar effectively absorbs energy from the impact. The flexibility of the collar 31 allows limited horizontal rotation of the neck to permit the player's head to pivot in the horizontal plane.

The terms and expressions which have been employed are used as terms of description and not of limitation. There is no intention in the use of such terms and expressions of excluding any equivalents of the features shown and described or portions thereof. It is recognized, therefore, that various modifications are possible within the scope and spirit of the invention. Accordingly, the invention incorporates variations that fall within the scope of the following claims.

I claim:

1. A head and neck guard for use with a head protector and shoulder gear for protecting a person against injury to the head or neck, comprising:

A. a generally frusto-conical neck brace having a first annular edge and a second annular edge in spaced relation to the first annular edge;

B. a first fastening means disposed along the first annular edge for attaching said neck brace to the head protector; and C. a second fastening means disposed along the second annular edge for attaching said neck brace to the shoulder gear.

2. The head and neck guard of claim 1, wherein the first and second fastening means each comprise a detachable fastener selected from the group consisting of snap fasteners, zippers, hook and loop fasteners, and combinations thereof.

3. The head and neck guard of claim 1, wherein the first and second fastening means each comprise a plurality of snap fasteners that engage with a plurality of snap connectors on the head protector and on the shoulder gear.

4. The head and neck guard of claim 1, wherein the frusto-conical neck brace comprises a continuous solid-walled enclosure surrounding the neck between said head protector and said shoulder gear.

5. The head and neck guard of claim 1, comprising a third edge and a fourth edge, said third edge and said fourth edge extending generally transverse to the first and second edge.

6. The head and neck guard of claim 1, wherein the neck brace is formed of an elastomeric material.

7. The head and neck guard of claim 1, wherein the neck brace is formed of neoprene.

8. The head and neck guard of claim 1, wherein the neck brace comprises an array of outward extensions between the first annular edge and the second annular edge.

9. A head and neck protection system for protecting a person against bodily injury, comprising:

A. a head protector;

B. a shoulder protector; and

C. a generally frusto-conical neck brace, connected between the head protector and the shoulder protector, said neck brace comprising:

(1) a first annular edge and a second annular edge in spaced relation from the first annular edge;

(2) a first fastening means extending along the first annular edge of the neck brace, said first fastener means being configured to detachably couple the neck brace with the head protector; and (3) a second fastening means extending along the second annular edge of the neck brace, said second fastener means being configured to detachably couple the neck brace with the shoulder protector.

10. The head and neck protection system of claim 9, wherein the first and second fastening means each comprise a detachable fastener selected from the group consisting of snap fasteners, zippers, hook and loop fasteners, and combinations thereof.

11. The head and neck protection system of claim 9, wherein the frusto-conical neck brace comprises a continuous solid-walled enclosure around the neck between said head protector and said shoulder protector.

12. The head and neck protection system of claim 9, wherein the neck brace comprises a third edge and a fourth edge, said third edge and said fourth edge extending generally transverse to the first and second edges.

13. The head and neck protection system of claim 9, wherein the neck brace is formed of an elastomer.

14. The head and neck protection system of claim 9, wherein the neck brace is formed of neoprene.

15. The head and neck protection system of claim 9, wherein the neck brace comprises an array of outward extensions between the first edge and the second edge.

16. A head and neck guard for use with a head protector and shoulder gear for protecting a person against injury to the head or neck, comprising:

a strip of elastic material having first and second edge portions in spaced relation to each other, and first and second end portions in spaced relation to each other, said strip of elastic material having a width between the first and second edge portions that is dimensioned to extend from the head protector to the shoulder gear and a length between the first and second end portions that is dimensioned such that said strip can be extended substantially around the entire neck area of the person;

a first fastening means disposed along the first edge portion for attaching said strip to the head protector; and a second fastening means disposed along the second edge portion for attaching said strip to the shoulder gear.

17. A head and neck guard as set forth in claim 16 wherein said strip of elastic material comprises a single solid strip of the elastic material.

18. A head and neck guard as set forth in claim 17 wherein the solid strip of the elastic material comprises a plurality of apertures formed therein and a plurality of solid panels spaced from one another by respective ones of said apertures.

19. A head and neck guard as set forth in claim 16 wherein the first edge portion has a length that is shorter than the length of the second edge portion, whereby said strip of elastic material is adapted to form a frusto-conical shape when attached between the head gear and the shoulder gear.

20. A head and neck guard as set forth in claim 16 wherein said strip of elastic material has a thickness that is selected to provide resistance to elongation and flexibility to permit rotation of the person's head about a vertical axis of the person's neck.

21. A head and neck guard as set forth in claim 16 wherein the length is dimensioned to provide a gap between the first and second end portions when the guard is positioned around the neck area of the person.

* * * * *